US006076193A

United States Patent [19]

Hood

[11] Patent Number: 6,076,193

[45] Date of Patent: Jun. 20, 2000

[54] CLOTHING ARRANGEMENT FOR PREVENTING THE BUNCHING OF MATERIAL IN THE CROTCH AREA OF A PERSON AND AN ASSOCIATED METHOD OF MAKING A PAIR OF PANTS

[76] Inventor: Jamie S. Hood, 5633 Gainesway Dr., Greenwood, Ind. 46142

[21] Appl. No.: 09/276,391

[22] Filed: Mar. 25, 1999

[51] Int. Cl.[7] ..... A41D 1/06

[52] U.S. Cl. ..... 2/227; 2/228; 2/231; 2/233; 450/106

[58] Field of Search ..... 2/227, 228, 238, 2/231, 233, 255–260, 264, 400, 408; 450/106, 100, 107, 112, 114, 143, 144

[56] References Cited

U.S. PATENT DOCUMENTS

| | | | |
|---|---|---|---|
| 279,549 | 6/1883 | Erlanger . | |
| 480,994 | 8/1892 | Bray | 2/264 |
| 512,113 | 1/1894 | Janowitz . | |
| 766,630 | 8/1904 | Kops | 2/264 |
| 819,774 | 5/1906 | Lefevre . | |
| 979,780 | 12/1910 | Marinsky . | |
| 1,019,339 | 3/1912 | McDermott . | |
| 1,687,158 | 10/1928 | Foster . | |
| 1,883,341 | 10/1932 | Dauphinais . | |
| 1,974,162 | 9/1934 | Schlaepfer . | |
| 2,005,480 | 6/1935 | Segelin et al. . | |
| 2,110,644 | 3/1938 | Bowman . | |
| 2,129,403 | 9/1938 | Bowman . | |
| 2,244,167 | 6/1941 | McGee . | |
| 2,288,212 | 6/1942 | Segelin et al. . | |
| 2,489,388 | 11/1949 | Rubin . | |
| 2,597,179 | 5/1952 | Pohlod . | |
| 2,614,261 | 10/1952 | McTighe . | |
| 2,864,376 | 12/1958 | Seperback | 450/114 |
| 2,895,482 | 7/1959 | Marino | 450/114 |
| 5,396,662 | 3/1995 | Leonard et al. . | |

FOREIGN PATENT DOCUMENTS

| | | |
|---|---|---|
| 26369 | 2/1910 | Austria . |
| 72484 | 5/1916 | Austria . |
| 109259 | 11/1927 | Germany . |
| 220933 | of 0000 | United Kingdom . |
| 25439 | of 1909 | United Kingdom . |
| 7314 | of 1913 | United Kingdom . |
| 1664 | 4/1992 | United Kingdom . |

*Primary Examiner*—Gloria M. Hale
*Attorney, Agent, or Firm*—Maginot, Addison & Moore

[57] ABSTRACT

A clothing arrangement is disclosed. The clothing arrangement includes a crotch area and a pant leg secured to the crotch area. The pant leg has (i) a lateral inner area and (ii) an interior lateral lower edge. The clothing arrangement also includes a stay member secured to the lateral inner area of the pant leg such that the stay member substantially prevents the interior lateral lower edge from moving toward the crotch area when the pant leg is worn by a person.

18 Claims, 5 Drawing Sheets

CLOTHING ARRANGEMENT FOR PREVENTING THE BUNCHING OF MATERIAL IN THE CROTCH AREA OF A PERSON AND AN ASSOCIATED METHOD OF MAKING A PAIR OF PANTS

BACKGROUND OF THE INVENTION

The present invention generally relates to clothing. The present invention particularly relates to a clothing arrangement for preventing the bunching of material of the clothing in the crotch area of a person, and an associated method of making a pair of pants.

Britches (sometimes referred to as "shorts") include pant legs that have a relatively short length. In particular, typically, each pant leg has a length such that a lower edge of each pant leg is spaced vertically above the knee of the person wearing the britches. The above described configuration allows the legs of the person wearing the britches to be directly exposed to the air.

Under certain circumstances, it is very desirable to have one's legs directly exposed to the air. For example, on very hot days a person would typically want their legs to be directly exposed to the air in order to help keep them cool. In addition, when a person participates in certain activities it is desirable to wear britches. For example, if a person is going to participate in an athletic activity or go for a walk, it would be desirable to wear britches since the pant leg length of the britches provides greater freedom of movement for the person wearing the britches as compared to full length trousers.

However, britches (and some full length trousers) suffer from the disadvantage that the material of the pant legs thereof tend to "bunch up" in the crotch area of the wearer. This "bunching up" in the crotch area of the wearer causes physical discomfort for the person wearing the britches (or trousers). Moreover, the "bunching up" of material makes the physical appearance of the britches, and thus the person wearing the britches, less attractive. Furthermore, the aforementioned "bunching up" results in the material of the britches becoming quite wrinkled and thus makes the britches more difficult to care for.

Therefore it is desirable to have a clothing arrangement which overcomes one or more of the problems set forth above.

SUMMARY OF THE INVENTION

In accordance with one embodiment of the present invention, there is provided a clothing arrangement. The clothing arrangement includes a crotch area and a pant leg secured to the crotch area. The pant leg has (i) a lateral inner area and (ii) an interior lateral lower edge. The clothing arrangement also includes a stay member secured to the lateral inner area of the pant leg such that the stay member substantially prevents the interior lateral lower edge from moving toward the crotch area when the pant leg is worn by a person.

Pursuant to another embodiment of the present invention, there is provided a method of making a pair of pants which include a pant leg having (i) a lateral inner area, (ii) an interior lateral lower edge, and (iii) a crotch area. The method includes the step of securing a stay member to the lateral inner area of the pant leg such that the stay member substantially prevents the interior lateral lower edge from moving toward the crotch area when the pant leg is worn by a person.

According to yet another embodiment of the present invention, there is provided a pair of trousers. The pair of trousers include a crotch area. The trousers also include a first pant leg attached to the crotch area. The first pant leg has (i) a first lateral inner area, (ii) a first interior lateral lower edge, and (iii) a first longitudinal axis. The trousers also include a second pant leg attached to the crotch area such that the crotch area is interposed between the first pant leg and the second pant leg. The second pant leg has (i) a second lateral inner area, (ii) a second interior lateral lower edge, and (iii) a second longitudinal axis. The trousers further include a first stay member having a third longitudinal axis. The first stay member is secured to the first lateral inner area of the first pant leg such that the third longitudinal axis is in a substantially parallel relationship with the first longitudinal axis. The trousers also include a second stay member having a fourth longitudinal axis. The second stay member is secured to the second lateral inner area of the second pant leg such that the fourth longitudinal axis is in a substantially parallel relationship with the second longitudinal axis. The first stay member substantially prevents the first interior lateral lower edge from moving toward the crotch area when the first pant leg is worn by a person. The second stay member substantially prevents the second interior lateral lower edge from moving toward the crotch area when the second pant leg is worn by the person.

It is therefore an object of the present invention to provide a new and useful clothing arrangement for preventing the bunching of material of the clothing in the crotch area of a person.

It is another object of the present invention to provide an improved clothing arrangement for preventing the bunching of material of the clothing in the crotch area of a person.

It is still another object of the present invention to provide a new and useful method of making a pair of pants.

It is another object of the present invention to provide an improved method of making a pair of pants.

It is still another object of the present invention to provide a clothing arrangement which increases the comfort of a person wearing a pair of britches.

It is yet another object of the present invention to provide a clothing arrangement which improves the appearance of a pair of britches being worn by a person.

It is still another object of the present invention to provide a clothing arrangement which decreases the care required for maintaining a pair of britches.

The above and other objects, features, and advantages of the present invention will become apparent from the following description and attached drawings.

DETAILED DESCRIPTION OF THE PREFERRED EMBODIMENT

Figure 1:
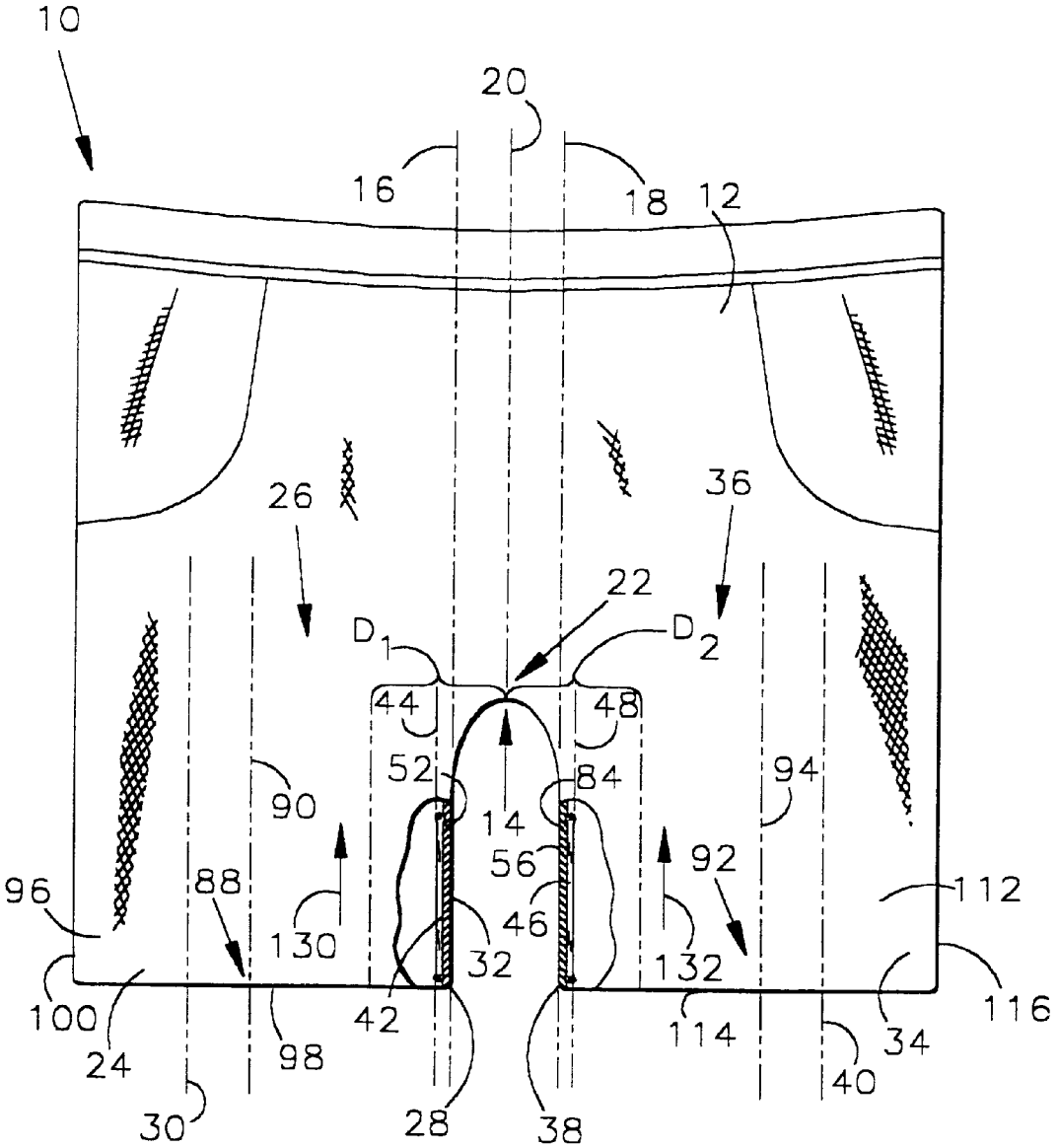
FIG. 1 is a front elevational fragmentary view of a pair of trousers which incorporate the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIGS. 1–4, there is shown a clothing arrangement 10 which incorporates the features of the present invention therein. Clothing arrangement 10 includes a pair of trousers 12. Trousers 12 includes a crotch area 14, a pant leg 24, a pant leg 34, a stay member 42, and a stay member 46.

As shown more clearly in FIG. 1, pant leg 24 has an interior lateral side wall 32. Pant leg 34 also has an interior lateral side wall 84. A linear extension of interior lateral side wall 32 is represented by line 16. A linear extension of interior lateral side wall 84 is represented by line 18. The portion of trousers 12 interposed between line 16 and line 18 is crotch area 14 of trousers 12. Crotch area 14 has a center point 22. Line 20 extends through center point 22.

Pant leg 24 is attached to crotch area 14. In addition, pant leg 34 is attached to crotch area 14 such that crotch area 14 is interposed between pant leg 24 and pant leg 34. Pant leg 24 has an interior lateral lower edge 28 and a longitudinal axis 30. Pant leg 24 also has an inseam 52 defined therein (also see FIG. 3). Pant leg 34 has an interior lateral lower edge 38 and a longitudinal axis 40. Pant leg 34 also has an inseam 56 defined therein.

Figure 5:
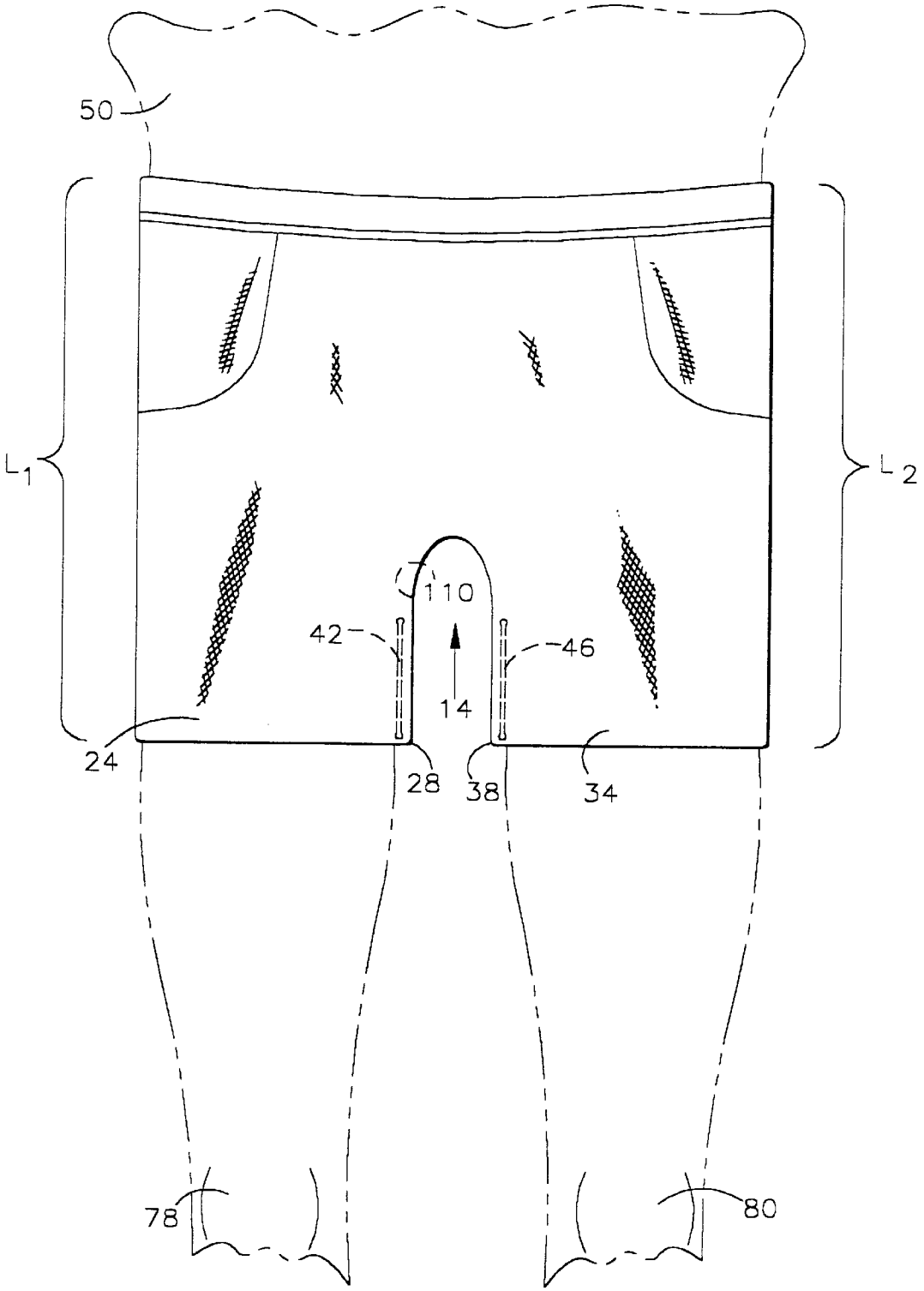
FIG. 5 is a front elevational view of the trousers of FIG. 1, but showing the trousers being worn by a person (note that a fragmentary view of the person is shown for clarity of description)

As shown in FIG. 5, pant leg 24 has a length $L_1$ such that interior lateral lower edge 28 of pant leg 24 is spaced vertically above a knee 78 of a person 50 when person 50 is wearing pant leg 24. Moreover, pant leg 34 has a length $L_2$ such that interior lateral lower edge 38 of pant leg 34 is spaced vertically above a knee 80 of person 50 when person 50 is wearing pant leg 34.

Figure 4:
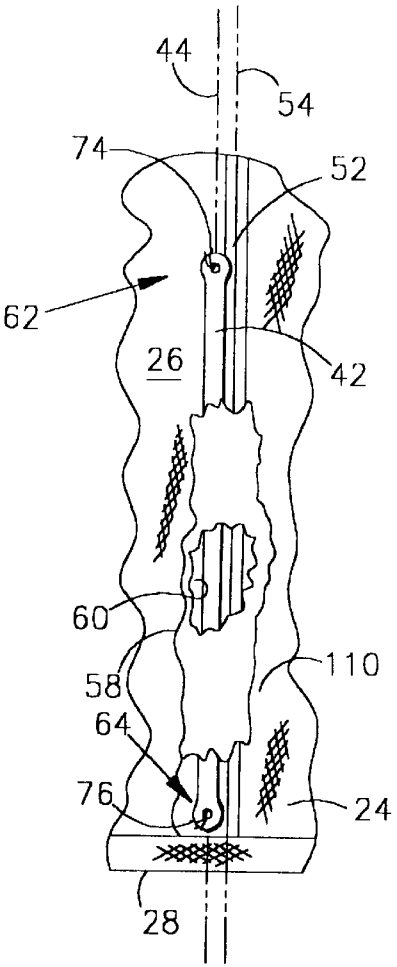
FIG. 4 is an enlarged fragmentary front elevational view of the stay member of FIG. 2, showing the stay member secured to an inseam of the pant leg of the trousers (note that a fragmentary view of the pant leg is shown for clarity of description)
Figure 3:
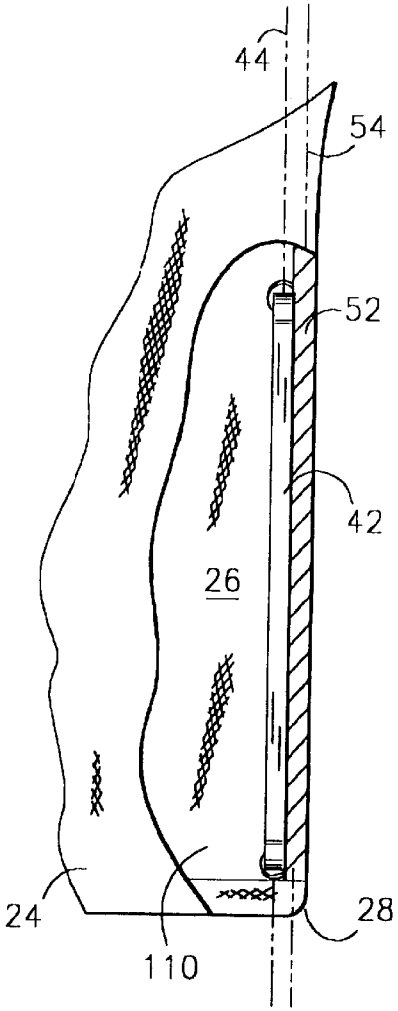
FIG. 3 is an enlarged side elevational view of the stay member of FIG. 2, showing the stay member secured to an inseam of the pant leg of the trousers (note that a fragmentary view of the pant leg is shown for clarity of description)
Figure 2:
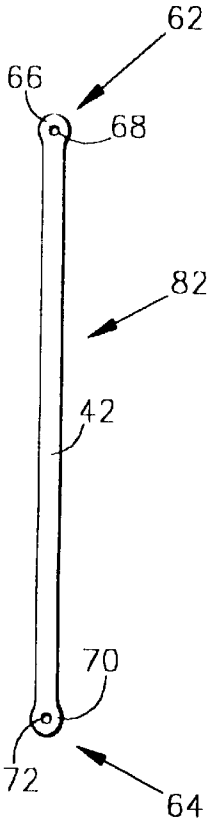
FIG. 2 is an enlarged front elevational view of a stay member utilized in the trousers shown in FIG. 1.

Referring now to FIGS. 2, 3, and 4, stay member 42 has an elongated portion 82, an end 62, and an end 64. End 62 defines a disk shaped area 66 having an aperture 68 defined therethrough. End 64 defines a disk shaped area 70 having an aperture 72 defined therethrough. It should be understood that stay member 46 is substantially identical to stay member 42. In particular, stay member 46 also has an elongated portion and two ends that define two disk shaped areas. In addition, each disk shaped area has an aperture defined therethrough. Both stay members 42 and 46 are preferably made from a plastic material.

Figure 7:
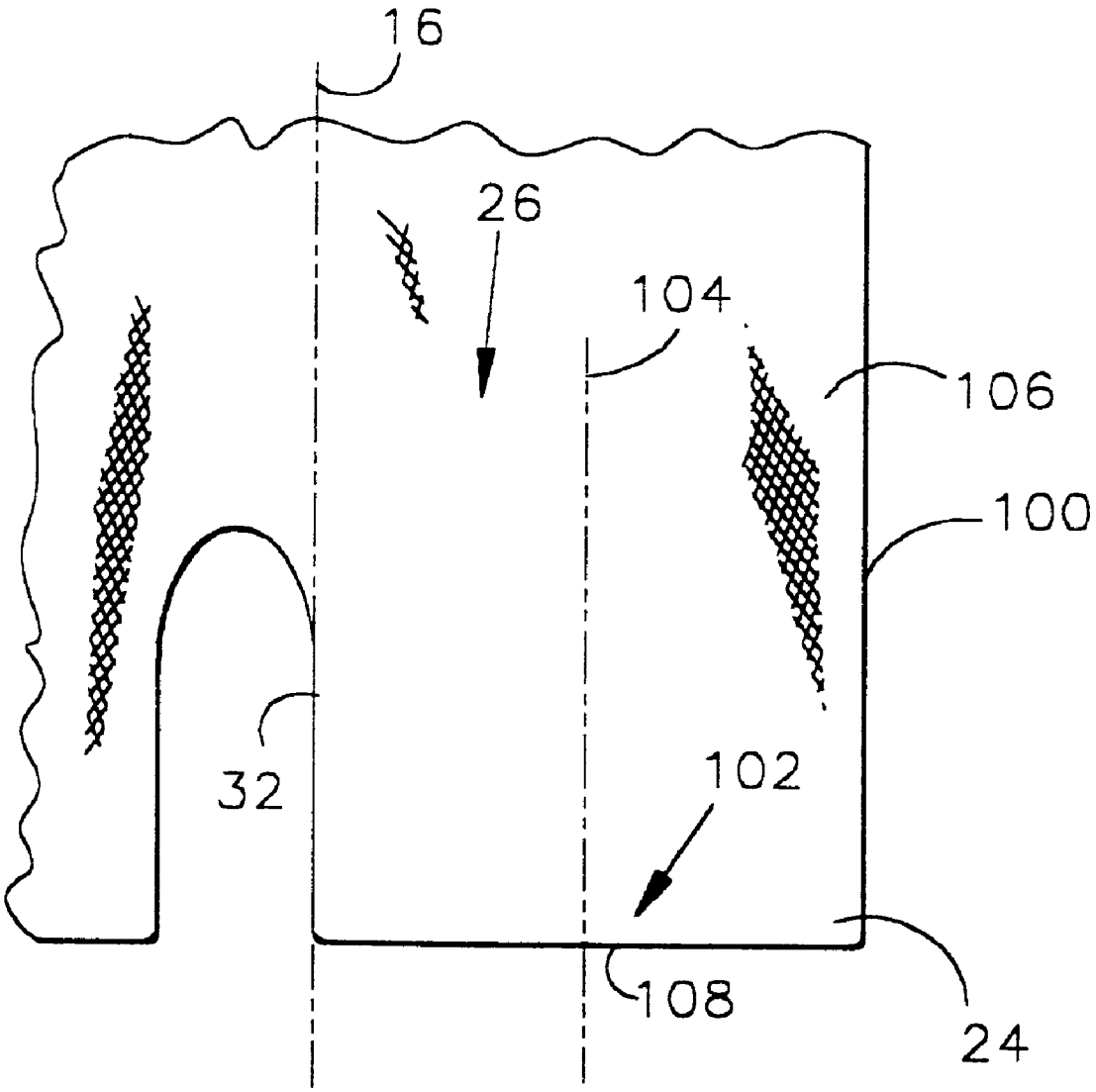
FIG. 7 is rear elevational fragmentary view of the trousers of FIG. 1.

As shown in FIGS. 1, 3 and 4, stay member 42 is secured to a lateral inner area 26 of pant leg 24. As shown in FIG. 1, lateral inner area 26 of pant leg 24 is defined herein as an area of the front surface 96 of pant leg 24 which is interposed between (i) a line 90 which intersects a front central lower edge 98 of pant leg 24 at a substantially 90° angle and passes through a front center point 88 of front central lower edge 98 and (ii) line 16 which is a linear extension of interior lateral side wall 32. Front center point 88 is defined herein as the point on front central lower edge 98 which is located an equal distance from interior lateral side wall 32 and an exterior lateral side wall 100 of pant leg 24. It should be understood that, as shown in FIG. 7, lateral inner area 26 is also defined herein so as to include an area of the back surface 106 of pant leg 24 which is interposed between (i) a line 104 which intersects a back central lower edge 108 of pant leg 24 at a substantially 90° angle and passes through a center point 102 of back central lower edge 108 and (ii) line 16 which is, as previously mentioned, a linear extension of interior lateral side wall 32.

It should be appreciated that lateral inner area 26 does not include a front seam (not shown) or a front crease (not shown) formed on front surface 96 of pant leg 24 which is aligned with line 90. Moreover, lateral inner area 26 does not include a back seam (not shown) or a back crease (not shown) formed on back surface 106 of pant leg 24 which is aligned with line 104.

Stay member 42 can be secured anywhere on lateral inner area 26 as long as the position of stay member 42 on lateral inner area 26 substantially prevents interior lateral lower edge 28 from moving toward crotch area 14 when pant leg 24 is worn by person 50. Preferably, stay member 42 is secured to an inner surface 110 (see FIGS. 3, 4, and 5) of lateral inner area 26 such that stay member 42 is positioned within a distance $D_1$ (see FIG. 1) of about 4 inches from center point 22 of crotch area 14. More preferably, stay member 42 is secured to lateral inner area 26 such that (i) stay member 42 is in direct contact with inseam 52 as shown more clearly in FIGS. 3 and 4 and (ii) a longitudinal axis 44 of stay member 42 is in a substantially parallel relationship with longitudinal axis 30 of pant leg 24 and linear extension 54 of inseam 52 (see FIGS. 3 and 4).

As shown in FIGS. 3 and 4, end 62 of stay member 42 is secured to lateral inner area 26 by inserting a thread 74 through (i) aperture 68 defined in end 62 of stay member 42 and (ii) lateral inner area 26 of pant leg 24. In a similar manner, end 64 is secured to lateral inner area 26 by inserting a thread 76 through (i) aperture 72 of defined in end 64 of stay member 42 and (ii) lateral inner area 26 of pant leg 24. Securing ends 62 and 64 in the above described manner secures stay member 42 to lateral inner area 26 of pant leg 24.

As shown in FIG. 4, a pouch 58 having an interior cavity 60 is secured to inner surface 110 of lateral inner area 26 of pant leg 24. For example, pouch 58 can be secured to inner surface 110 of lateral inner area 26 such that inseam 52 is located within interior cavity 60. Preferably, pouch 58 and trousers 12 are made from the same material. Stay member 42 is located within interior cavity 60 of pouch 58.

As shown in FIG. 1, stay member 46 is secured to a lateral inner area 36 of pant leg 34. As shown in FIG. 1, lateral inner area 36 of pant leg 34 is defined herein as an area of the front surface 112 of pant leg 34 which is interposed between (i) a line 94 which intersects a front central lower edge 114 of pant leg 34 at a substantially 90° angle and passes through a front center point 92 of front central lower edge 114 and (ii) line 18 which is a linear extension of interior lateral side wall 84. Front center point 92 is defined herein as the point on front central lower edge 114 which is located an equal distance from interior lateral side wall 84 and an exterior lateral side wall 116 of pant leg 34. It should be understood that lateral inner area 36 is also defined herein so as to include an area of the back surface (not shown) of pant leg 34 which corresponds to the area described above in reference to the back surface 106 of pant leg 24.

Stay member 46 is secured to lateral inner area 36 of pant leg 34 in a substantially identical manner as described above for stay member 42. For example, stay member 46 is preferably secured to lateral inner area 36 of pant leg 34 such that stay member 46 is positioned within a distance $D_2$ (see FIG. 1) of about 4 inches from center point 22 of crotch area 14. More preferably, stay member 46 is secured to lateral inner area 36 such that (i) stay member 46 is in direct contact with inseam 56 (see FIG. 1) and (ii) a longitudinal axis 48 of stay member 46 is in a substantially parallel relationship with longitudinal axis 40 of pant leg 34 and the linear extension (not shown) of inseam 56.

Positioning and securing stay members 42 and 46 in the above described manner substantially prevents pant legs 24 and 34 of trousers 12 from "bunching up" in crotch area 14 when being worn by person 50. Specifically, stay member 42 substantially prevents interior lateral lower edge 28 of pant leg 24 from moving toward crotch area 14 in the direction indicated by arrow 130 when pant leg 24 is worn by person 50. Substantially, preventing interior lateral lower edge 28 of pant leg 24 from moving toward crotch area 14 in the above described manner, also substantially prevents pant leg 24 from "bunching up" in crotch area 14. In addition, stay member 46 substantially prevents interior lateral lower edge 38 of pant leg 34 from moving toward crotch area 14 in the direction indicated by arrow 132 when pant leg 34 is worn by person 50. Substantially, preventing interior lateral lower edge 38 of pant leg 34 from moving toward crotch area 14 in the above described manner, also substantially prevents pant leg 34 from "bunching up" in crotch area 14.

Figure 6:
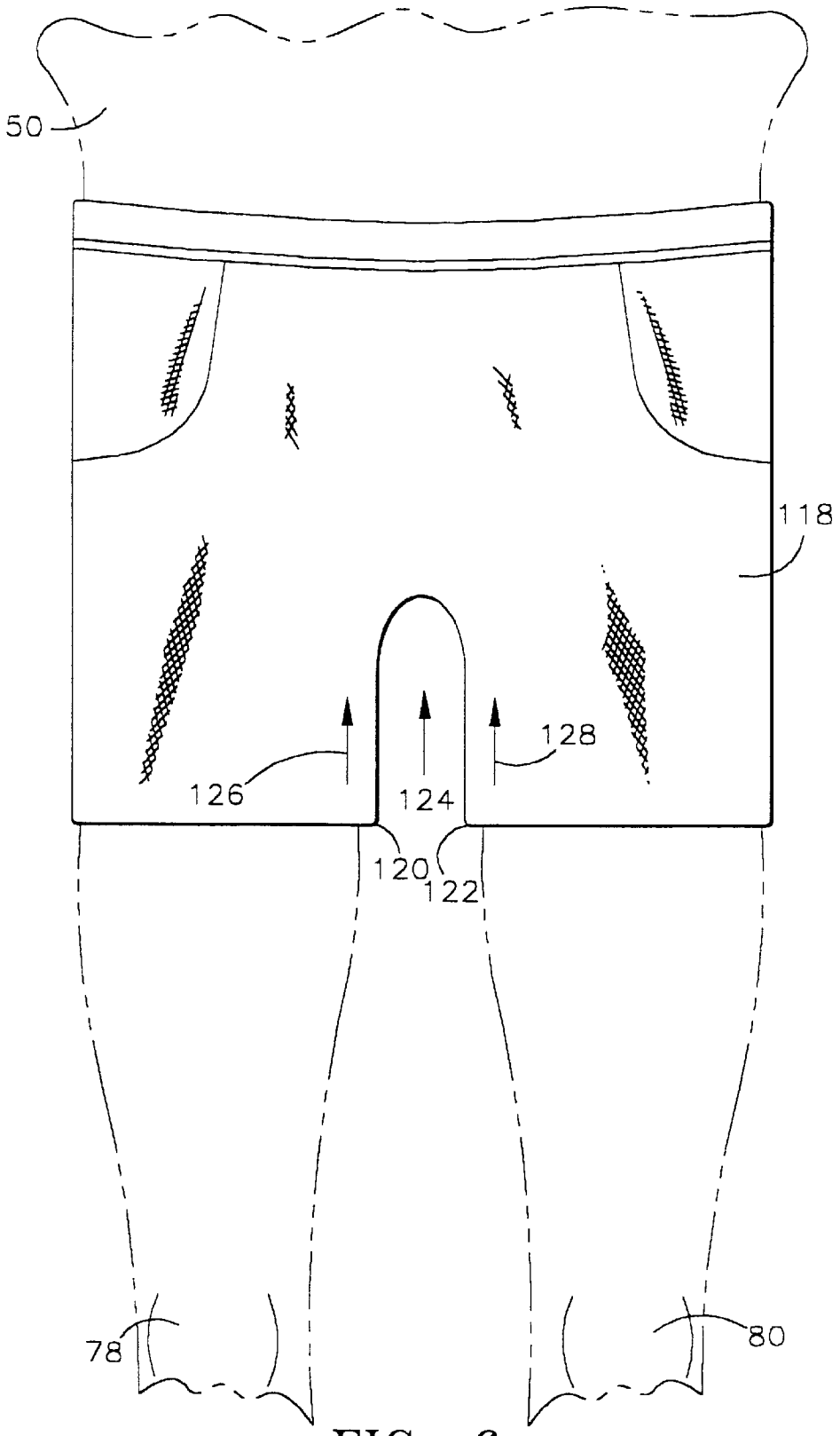
FIG. 6 is front elevational view of a pair of shorts being worn by a person showing the material of the trousers bunching up in the crotch area of the person.

This is in contrast to other trousers which do not have stay members 42 and 46 of the present invention incorporated therein. For example, as shown in FIG. 6, trousers 118 do not have stay members 42 and 46 of the present invention incorporated therein. As a result, when trousers 118 are worn by person 50 interior lower lateral edges 120 and 122 of trousers 118 can move toward crotch area 124 in the direction indicated by arrows 126 and 128 and thus cause trousers 118 to "bunch up" in crotch area 124 of trousers 118. This "bunching up" of trousers 118 causes the aforementioned problems associated with wearing trousers 118. Specifically, this "bunching up" causes physical discomfort for person 50 when wearing trousers 118. Moreover, the "bunching up" makes the physical appearance of trousers 118, and thus person 50, less attractive. Furthermore, the aforementioned "bunching up" results in the material of trousers 118 becoming quite wrinkled and thus makes trousers 118 more difficult to care for.

Thus, it should be appreciated that having stay members 42 and 46 positioned and secured to trousers 12 in the above described manner address the previously described problems. In particular, since stay members 42 and 46 substantially prevent the aforementioned "bunching up", stay members 42 and 46 also (i) make trousers 12 more comfortable to wear, (ii) enhance the physical appearance of trousers 12, and (iii) decrease the wrinkling of trousers 12.

While the invention has been illustrated and described in detail in the drawings and foregoing description, such illustration and description is to be considered as exemplary and not restrictive in character, it being understood that only the preferred embodiments have been shown and described and that all changes and modifications that come within the spirit of the invention are desired to be protected.

What is claimed is:

1. A clothing arrangement, comprising:

a crotch area;

a pant leg secured to said crotch area, said pant leg having (i) a lateral inner area and (ii) an interior lateral lower edge; and a stay member secured to said lateral inner area of said pant leg such that said stay member substantially prevents said interior lateral lower edge from moving toward said crotch area when said pant leg is worn by a person, wherein said pant leg has a first longitudinal axis, said stay member includes an elongated portion having (i) a first end, (ii) a second, and (iii) a second longitudinal axis, and said first end of said elongated portion and said second end of said elongated portion are secured to said lateral inner area such that said first longitudinal axis and said second longitudinal axis are in a substantially parallel relationship.

2. The clothing arrangement of claim 1, wherein:

said pant leg has an inseam defined in said lateral inner area such that a linear extension of said inseam is in a substantially parallel relationship with said first longitudinal axis of said pant leg, and said first end of said elongated portion and said second end of said elongated portion are secured to said pant leg such that (i) said elongated portion is in contact with said inseam and (ii) said elongated portion is in a substantially parallel relationship with said linear extension of said inseam.

3. The clothing arrangement of claim 1, wherein:

said first end of said elongated portion defines a first disk shaped area having a first aperture defined therethrough, said second end of said elongated portion defines a second disk shaped area having a second aperture defined therethrough, said first end of said elongated portion is secured to said lateral inner area with a first thread inserted through said first aperture and said pant leg, and said second end of said elongated portion is secured to said lateral inner area with a second thread inserted through said second aperture and said pant leg.

4. The clothing arrangement of claim 1, further comprising:

a pouch secured to said lateral inner area of said pant leg, wherein said pouch has an interior cavity and said stay member is positioned within said interior cavity.

5. The clothing arrangement of claim 1, wherein:

said stay member is made from a plastic material.

6. The clothing arrangement of claim 1, wherein:

said pant leg has a first length $L_1$ such that said interior lateral lower edge of said pant leg is spaced vertically above a knee of said person when said person is wearing said pant leg.

7. A method of making a pair of pants which include a pant leg having (i) a lateral inner area, (ii) an interior lateral lower edge, (iii) a first longitudinal axis, and (iv) a crotch area, comprising the steps of:

providing a stay member which includes an elongated portion having (a) a first end, (b) a second end, and (c) a second longitudinal axis; and securing said first end and said second end of said elongated portion of said stay member to said lateral inner area such that (i) said first longitudinal axis of said pant leg and said second longitudinal axis of said elongated portion are in a substantially parallel relationship and (ii) said stay member substantially prevents said interior lateral lower edge from moving toward said crotch area when said pant leg is worn by a person.

8. The method of claim 7, further comprising the steps of:

forming an inseam in said lateral inner area of said pant leg such that a linear extension of said inseam is in a substantially parallel relationship with said first longitudinal axis of said pant leg; and securing said first and said second end of said elongated portion to said pant leg such that (i) said elongated portion is in contact with said inseam and (ii) said elongated portion is in a substantially parallel relationship with said linear extension of said inseam.

9. The method of claim 7, wherein (i) said first end of said elongated portion defines a first disk shaped area having a first aperture defined therethrough and (ii) said second end of said elongated portion defines a second disk shaped area having a second aperture defined therethrough, further comprising the steps of:

securing said first end of said elongated portion to said lateral inner area of said pant leg with a first thread inserted through said first aperture and said pant leg; and securing said second end of said elongated portion to said lateral inner area of said pant leg with a second thread inserted through said second aperture and said pant leg.

10. The method of claim 7, further comprising the steps of:

forming a pouch having an inner cavity on said lateral inner area of said pant leg; and positioning said stay member within said interior cavity of said pouch when said stay member is secured to said lateral inner area of said pant leg.

11. The method of claim 7, wherein:

said stay member is made from a plastic material.

12. The method of claim 7, wherein:

said pant leg has a first length $L_1$ such that said interior lateral lower edge of said pant leg is spaced vertically above a knee of said person when said person is wearing said pant leg.

13. A pair of trousers, comprising:

a crotch area;

a first pant leg attached to said crotch area, said first pant leg having (i) a first lateral inner area, (ii) a first interior lateral lower edge, and (iii) a first longitudinal axis;

a second pant leg attached to said crotch area such that said crotch area is interposed between said first pant leg and said second pant leg, said second pant leg having (i) a second lateral inner area, (ii) a second interior lateral lower edge, and (iii) a second longitudinal axis;

a first stay member having a third longitudinal axis, said first stay member being secured to said first lateral inner area of said first pant leg such that said third longitudinal axis is in a substantially parallel relationship with said first longitudinal axis; and a second stay member having a fourth longitudinal axis, said second stay member being secured to said second lateral inner area of said second pant leg such that said fourth longitudinal axis is in a substantially parallel relationship with said second longitudinal axis, wherein (i) said first stay member substantially prevents said first interior lateral lower edge from moving toward said crotch area when said first pant leg is worn by a person and (ii) said second stay member substantially prevents said second interior lateral lower edge from moving toward said crotch area when said second pant leg is worn by said person.

14. The trousers of claim 13, further comprising:

a first inseam defined in said first lateral inner area such that a linear extension of said first inseam is in a substantially parallel relationship with said first longitudinal axis of said first pant leg; and a second inseam defined in said second lateral inner area such that linear extension of said second inseam is in a substantially parallel relationship with said second longitudinal axis of said second pant leg, wherein (i) said first stay member is secured to said first pant leg such that (a) said first stay member is in contact with said first inseam and (b) said third longitudinal axis of said first stay member is in a substantially parallel relationship with said linear extension of said first inseam and (ii) said second stay member is secured to said second pant leg such that (a) said second stay member is in contact with said second inseam and (b) said fourth longitudinal axis of said second stay member is in a substantially parallel relationship with said linear extension of said second inseam.

15. The trousers of claim 13, further comprising:

a first pouch secured to said first lateral inner area of said first pant leg; and a second pouch secured to said second lateral inner area of said second pant leg, wherein (i) said first pouch has a first interior cavity and said first stay member is positioned within said first interior cavity and (ii) said second pouch has a second interior cavity and said second stay member is positioned within said second interior cavity.

16. The trousers of claim 13, wherein:

said first stay member and said second stay member are made from a plastic material.

17. The trousers of claim 13, wherein:

said first stay member has a first end and a second end, said second stay member has a third end and a forth end, said first end defines a first disk shaped area having a first aperture defined therethrough, said second end defines a second disk shaped area having a second aperture defined therethrough, said third end defines a third disk shaped area having a third aperture defined therethrough, said forth end defines a forth disk shaped area having a forth aperture defined therethrough, said first end of said first stay member is secured to said first lateral inner area with a first thread inserted through said first aperture and said first lateral inner area, said second end of said first stay is secured to said first lateral inner area with a second thread inserted through said second aperture and said first lateral inner area, said third end of said second stay member is secured to said second lateral inner area with a third thread inserted through said third aperture and said second lateral inner area, and said fourth end of said second stay is secured to said second lateral inner area with a fourth thread inserted through said fourth aperture and said second lateral inner area.

18. The trousers of claim 13, wherein:

said first pant leg has a first length LI such that said first interior lateral lower edge of said first pant leg is spaced vertically above a first knee of said person when said person is wearing said first pant leg, and said second pant leg has a second length $L_2$ such that said second interior lateral lower edge of said second pant leg is spaced vertically above a second knee of said person when said person is wearing said second pant leg.

* * * * *